US010669875B2

(12) United States Patent
Hernandez et al.

(10) Patent No.: US 10,669,875 B2
(45) Date of Patent: Jun. 2, 2020

(54) CROSS KEY ANTI-ROTATION SPACER

(71) Applicant: Solar Turbines Incorporated, San Diego, CA (US)

(72) Inventors: Jorge Hernandez, La Mesa, CA (US); David Jeorling, San Diego, CA (US); Makarand Sovani, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 225 days.

(21) Appl. No.: 15/939,070

(22) Filed: Mar. 28, 2018

(65) Prior Publication Data

US 2019/0301295 A1 Oct. 3, 2019

(51) Int. Cl.
*F01D 11/00* (2006.01)
*F04D 29/32* (2006.01)

(52) U.S. Cl.
CPC ..... *F01D 11/005* (2013.01); *F04D 29/321* (2013.01); *F05D 2220/32* (2013.01); *F05D 2230/80* (2013.01)

(58) Field of Classification Search
CPC ..... F01D 11/005; F01D 11/008; F01D 5/30; F04D 29/321
See application file for complete search history.

(56) References Cited

U.S. PATENT DOCUMENTS

| | | | | |
|---|---|---|---|---|
| 2,916,256 | A | 12/1959 | Welch | |
| 7,186,079 | B2 | 3/2007 | Suciu et al. | |
| 9,540,935 | B2 * | 1/2017 | Perdrigeon | F01D 5/3015 |
| 9,945,386 | B2 * | 4/2018 | Lee | F04D 27/001 |
| 2009/0297350 | A1 | 12/2009 | Augustine et al. | |
| 2011/0305576 | A1 | 12/2011 | Ward et al. | |
| 2012/0051918 | A1 | 3/2012 | Glasspoole et al. | |
| 2012/0315142 | A1 | 12/2012 | Bosco | |
| 2014/0064946 | A1 * | 3/2014 | Nielsen | F01D 5/06 415/199.5 |
| 2017/0218770 | A1 * | 8/2017 | Griffin et al. | F01D 5/3015 |
| 2017/0234320 | A1 | 8/2017 | Lee et al. | |

FOREIGN PATENT DOCUMENTS

| | | |
|---|---|---|
| EP | 1591622 | 11/2005 |
| FR | 3048998 A1 | 9/2017 |

* cited by examiner

*Primary Examiner* — David E Sosnowski
*Assistant Examiner* — Sabbir Hasan
(74) *Attorney, Agent, or Firm* — Procopio, Cory, Hargreaves & Savitch LLP

(57) ABSTRACT

This disclosure provides a cross key anti rotation spacer for use in a gas turbine engine. A compressor disk assembly can have a cross key ring having a plurality of keys, teeth, or castellations, alternating with a plurality of gaps to form a cross key surface. The keys or teeth of the cross key surface can mesh with corresponding teeth formed on a spacer of a compressor rotor assembly. The spacer teeth, in connection with the teeth or keys of the cross key ring can prevent rotation between the spacer and compressor disk. This is particularly beneficial during transient operations, such as startup and shutdown of the gas turbine engine.

10 Claims, 6 Drawing Sheets

CROSS KEY ANTI-ROTATION SPACER

BACKGROUND

Technological Field

The present disclosure generally pertains to gas turbine engines, and is more particularly directed toward the prevention of rotation of compressor spacers.

Related Art

Gas turbine engines include compressor, combustor, and turbine sections. Components of the gas turbine engine sections are subject to high temperatures and pressures. These temperatures and pressures may vary during transients of the gas turbine engine, especially during start up and shut down of the gas turbine engine. The components may thermally expand at different rates resulting in a loss of pilot between components and thermal stresses and strains within components.

U.S. Patent Application Publication No. 2012/0051918 to Glasspoole, describes a retaining ring arrangement for axially holding a component on a rotating component of a gas turbine engine. The retaining ring arrangement comprises a split retaining ring mounted in a circumferential groove defined in a radially outer surface of the rotating component. The inner diameter of the retaining ring is biased inwardly in radial contact with a radially outer facing seat provided on one of the two components to be assembled. An anti-rotation feature is provided at the inner diameter of the retaining ring for restraining the ring against rotation. A sleeve surrounds the retaining ring to limit radial expansion thereof when subject to centrifugal forces during engine operation.

U.S. Patent Application Publication No. 2012/0315142 to Bosco, is directed to a mechanism for compressing a sealing ring of a cooling circuit of blades of a turbine engine against a turbine wheel supporting the blades, the wheel supporting on a downstream surface thereof an annular flange positioned radially and defining with the surface a groove configured to house the sealing ring. The flange includes at least two cut-outs on the edge thereof located opposite the bottom of the groove, to form windows for axial insertion in the groove for claws supported by the circumference of the ring facing the groove of the wheel. The mechanism includes a bolt tab configured to be positioned in the groove between the surface of the wheel and the ring, and a clamping shaped to be supported by the surface of the wheel and to engage with the bolt to ensure that the ring is compressed against the flange.

The present disclosure is directed toward overcoming one or more of the problems discovered by the inventors.

SUMMARY

In general, this disclosure describes systems and methods related to a cross key anti-rotation spacer in a turbine engine. The systems, methods and devices of this disclosure each have several innovative aspects, no single one of which is solely responsible for the desirable attributes disclosed herein.

One aspect of the disclosure provides a compressor disk assembly. The compressor disk assembly can have a cross key ring. The cross key ring can have an annular body having a circumference defined by an outer surface, and a ring aft face orthogonal to the outer surface. The cross key ring can have a plurality of keys alternating with a plurality of gaps forming a cross key surface opposite the ring aft face, each key of the plurality of keys spanning an annular sector of the cross key surface. The compressor disk assembly can have a compressor disk configured to receive a plurality of compressor blades about an outer circumference. The compressor disk can have a rim extending from an outer portion of the compressor disk defining the outer circumference of the compressor disk. The compressor disk can have a forward disk face disposed radially inward from the rim. The compressor disk can have a forward extension extending axially forward from the rim and defining an extension depth. The extension depth can extend from the forward disk face to a forward extension face along a forward extension inner surface. The forward extension can receive the cross key ring in an interference fit with the forward extension inner surface, such that the ring aft face is disposed adjacent to the forward disk face, and the outer surface adjacent to the forward extension inner surface.

Another aspect of the disclosure provides a compressor rotor assembly for use in a gas turbine engine. The compressor rotor assembly can have a compressor disk having a rim, the rim having an outer surface defining a disk outer surface, the rim configured to receive a plurality of rotor blades about the disk outer surface. The compressor rotor assembly can have a cross key ring disposed radially inward of the rim, the cross key ring having a plurality of keys alternating with a plurality of gaps forming a cross key surface opposite a ring aft face, each key of the plurality of keys spanning an annular sector of the cross key surface. The compressor rotor assembly can have a spacer. The spacer can have a spacer body having a substantially annular shape and a spacer outer surface. The spacer can have a plurality of spacer teeth formed on an aft face of the spacer body, each spacer tooth of the plurality of spacer teeth spanning an annular sector of the aft face, the plurality spacer teeth configured to engage with the plurality of keys.

Another aspect of the disclosure provides a method for retrofitting a gas turbine engine. The method can include forming a forward disk face on a compressor disk radially inward from a rim, the rim having an outer surface defining a disk outer surface of the compressor disk, the rim configured to receive a plurality of rotor blades about the disk outer surface. The method can include forming a forward extension inner surface extending an extension depth from the forward disk face of the compressor disk to a forward extension face of a forward extension, the forward extension extending axially forward from the rim. The method can include fitting a cross key ring to the compressor disk, the cross key ring having a plurality of keys alternating with a plurality of gaps forming a cross key surface opposite a ring aft face, each key of the plurality of keys spanning an annular sector of the cross key surface, the fitting further disposing the ring aft face adjacent the forward disk face.

Other features and advantages of the present disclosure should be apparent from the following description which illustrates, by way of example, aspects of the disclosure.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in simplified form for brevity of description.

Figure 1:
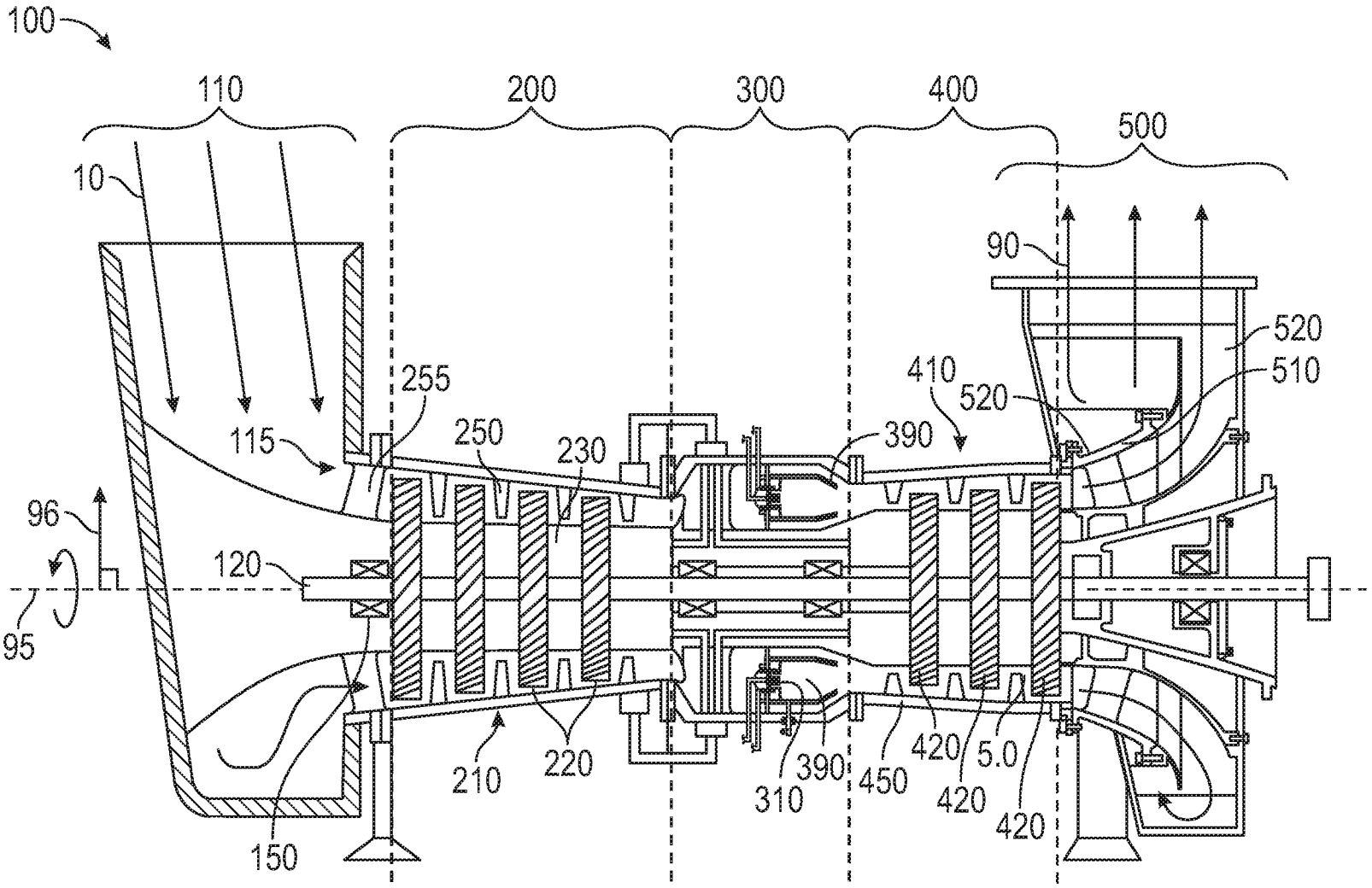
FIG. 1 is a is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or "compressor" 200, a combustor 300, a turbine 400, an exhaust 500, and a power output coupling. The gas turbine engine 100 may have a single shaft or a dual shaft configuration. Dashed lines in FIG. 1 approximate the different sections of the gas turbine engine 100.

Figure 2:
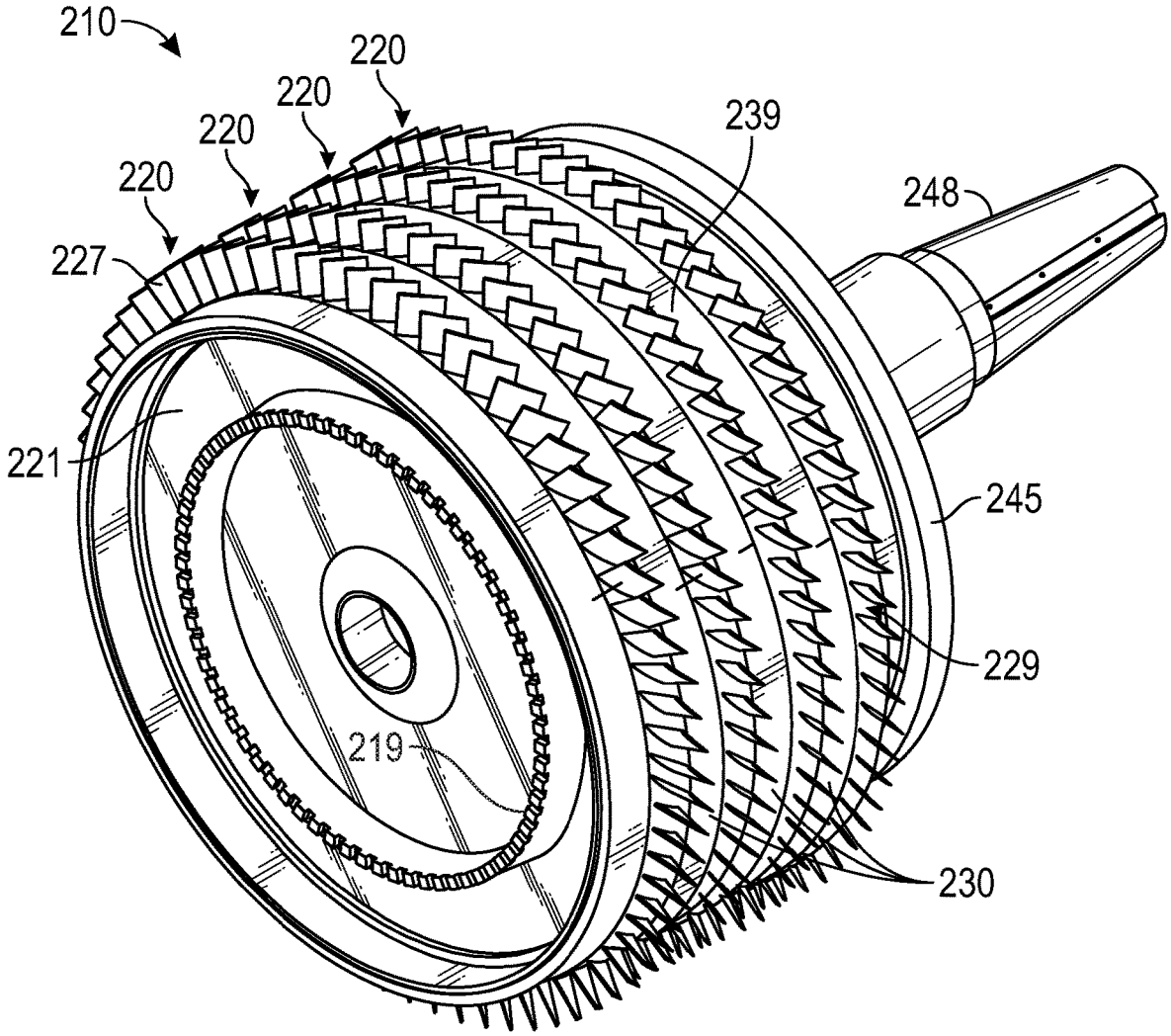
FIG. 2 is a perspective view of an aft portion of the compressor rotor assembly 210 of FIG. 1.

The compressor 200 includes a compressor rotor assembly 210, compressor stationary vanes ("stators") 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220 and one or more spacers 230. Each compressor disk assembly 220 includes a compressor rotor disk 221 (FIG. 2) that is circumferentially populated with compressor rotor blades 227 (FIG. 2). In embodiments, each spacer 230 extends between the rims 222 of adjacent compressor disk assemblies 220 (Refer to FIG. 3). Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 may axially precede the first compressor stage.

The combustor 300 includes one or more injectors 310 and includes one or more combustion chambers 390.

The turbine 400 includes a turbine rotor assembly 410, and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. A turbine nozzle 450 axially precedes each of the turbine disk assemblies 420. Each turbine disk assembly 420 paired with the adjacent turbine nozzle 450 that precedes the turbine disk assembly 420 is considered a turbine stage. Turbine 400 includes multiple turbine stages.

The exhaust 500 includes an exhaust diffuser 510 and an exhaust collector 520.

FIG. 2 is a perspective view of an aft portion of the compressor rotor assembly 210 of FIG. 1. The compressor rotor assembly 210 includes compressor disk assemblies 220, spacers 230, and rear hub 245. Each compressor disk assembly 220 includes a compressor rotor disk ("disk") 221 and a plurality of compressor rotor blades 227. Disks 221 are coupled or welded together when forming the compressor rotor assembly 210. In the embodiment shown, disks 221 are coupled together with curvic teeth 219. Each disk 221 is circumferentially populated with compressor rotor blades 227.

Each disk 221 may include a disk outer surface 229. The disk outer surface 229 is the radially outer surface of the disk 221 and defines a portion of the inner surface of the flow path through the compressor 200.

Each spacer 230 may include a spacer outer surface 239. The spacer outer surface 239 is the radially outer surface of the spacer 230 and defines a portion of the inner surface of the flow path through the compressor 200. The spacer outer surface 239 may generally be flush with the disk outer surface 229, to form the inner surface of the flow path of the air 10 through the compressor 200.

Rear hub 245 may be located aft of disks 221 and is generally the most aft component of compressor rotor assembly 210. Rear hub 245 may have a disk shape. Shaft interface 248 extends aft from the disk shape of rear hub 245 with a cylindrical shape. Shaft interface 248 may be tapered for coupling to a portion of shaft 120.

Figure 3:
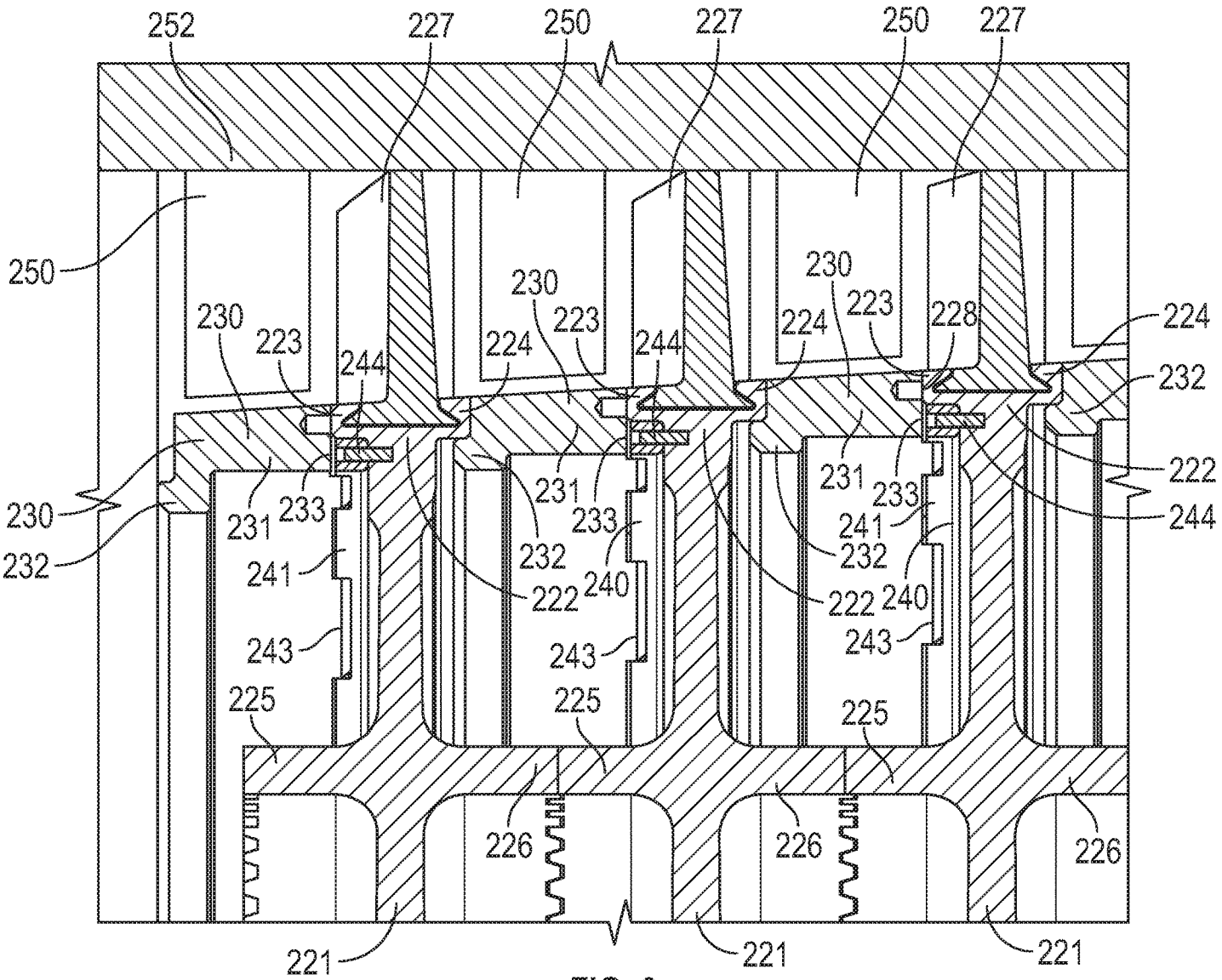
FIG. 3 is a cross-sectional view of a portion of the compressor 200 of a gas turbine engine which may be used in the gas turbine engine 100 of FIG. 1.

FIG. 3 is a cross-sectional view of a portion of the compressor 200 of a gas turbine engine which may be used in the gas turbine engine 100 of FIG. 1. Disk 221 of each compressor disk assembly 220 (FIG. 2) includes a rim 222, a forward arm 225, and an aft arm 226. Rim 222 is located at the radial outermost portion of the disk 221 and may be located at a radially outer circumference of disk 221. In one embodiment rim 222 circumferentially extends completely around disk 221. Generally, each rim 222 includes forward extension 223 extending axially forward and aft extension 224 extending axially aft. In one embodiment both forward extension 223 and aft extension 224 circumferentially extend completely around disk 221. The forward extension 223 can have a forward extension face 228.

Forward arm 225 and aft arm 226 are located radially inward from rim 222 and radially outward from the axis of disk 221. Forward arm 225 and aft arm 226 may couple adjacent disks 221 together (e.g., via the curvic teeth 219). In one embodiment forward arm 225 and aft arm 226 circumferentially extend completely around disk 221. Forward arm 225 extends axially forward and aft arm 226 extends axially aft. Each disk 221 couples to an adjacent disk 221. The forward arm 225 of one disk radially aligns with the aft arm of an adjacent disk 221. In one embodiment each forward arm 225 and each aft arm 226 includes the curvic teeth 219 (FIG. 2).

Compressor rotor blades 227 couple to disks 221 at rim 222. Each compressor rotor blade 227 includes a base (not shown) with a retaining feature such as a fir tree or a dovetail. Slots in rim 222 have a corresponding retaining feature that secures each compressor rotor blade 227 to disk 221.

Each spacer 230 is shaped generally as a hollow cylinder or annular ring. Spacers 230 span between adjacent disks 221 and couple to adjacent rims 222 with a press fit, slip fit, or interference fit. In one embodiment, the forward end of the spacers 230 couple to an adjacent disk 221 with a slip fit, while the aft end of the spacers 230 couple to an adjacent disk 221 with a press fit. In another embodiment, the forward end of the spacers 230 couple to an adjacent disk 221 with a press fit, while the aft end of the spacers 230 couple to an adjacent disk 221 with a slip fit. Spacers 230 are located radially inward from stators 250.

Each stator 250 may extend radially inward from a stator shroud 252 towards the spacer 230. Stators 250 may be circumferentially aligned and be positioned radially outward from the spacer 230 to form a fluid nozzle between compressor rotor disks 221.

Each spacer 230 can have a cylindrical body 231, a forward lip 232, and an aft face 233. Body 231 may be a hollow cylinder or annular ring. Forward lip 232 may extend axially forward from body 231. Forward lip 232 may be an annular flange extending forward from body 231. Aft face 233 may extend axially aft from body 231 in the direction opposite forward lip 232. Aft face 233 may be an annular flange extending aft from body 231.

The forward lip 232 may axially overlap with aft extension 224 of an adjacent disk 221 and may be located radially inward from aft extension 224. Forward lip 232 may have a slip fit, a press fit, or an interference fit with aft extension 224. Aft face 233 may axially overlap with forward extension 223 of an adjacent disk 221 and may be located radially inward from forward extension 223. Aft face 233 may have a slip fit, press fit, or an interference fit with forward extension 223 at the forward extension face 228.

The compressor rotor assembly 210 may also include one or more cross key rings 240 disposed between each spacer 230 and disk 221. The cross key ring 240 can prevent the spacer 230 from slipping (in a rotational direction) with respect to the adjacent disk 221.

Figure 4:
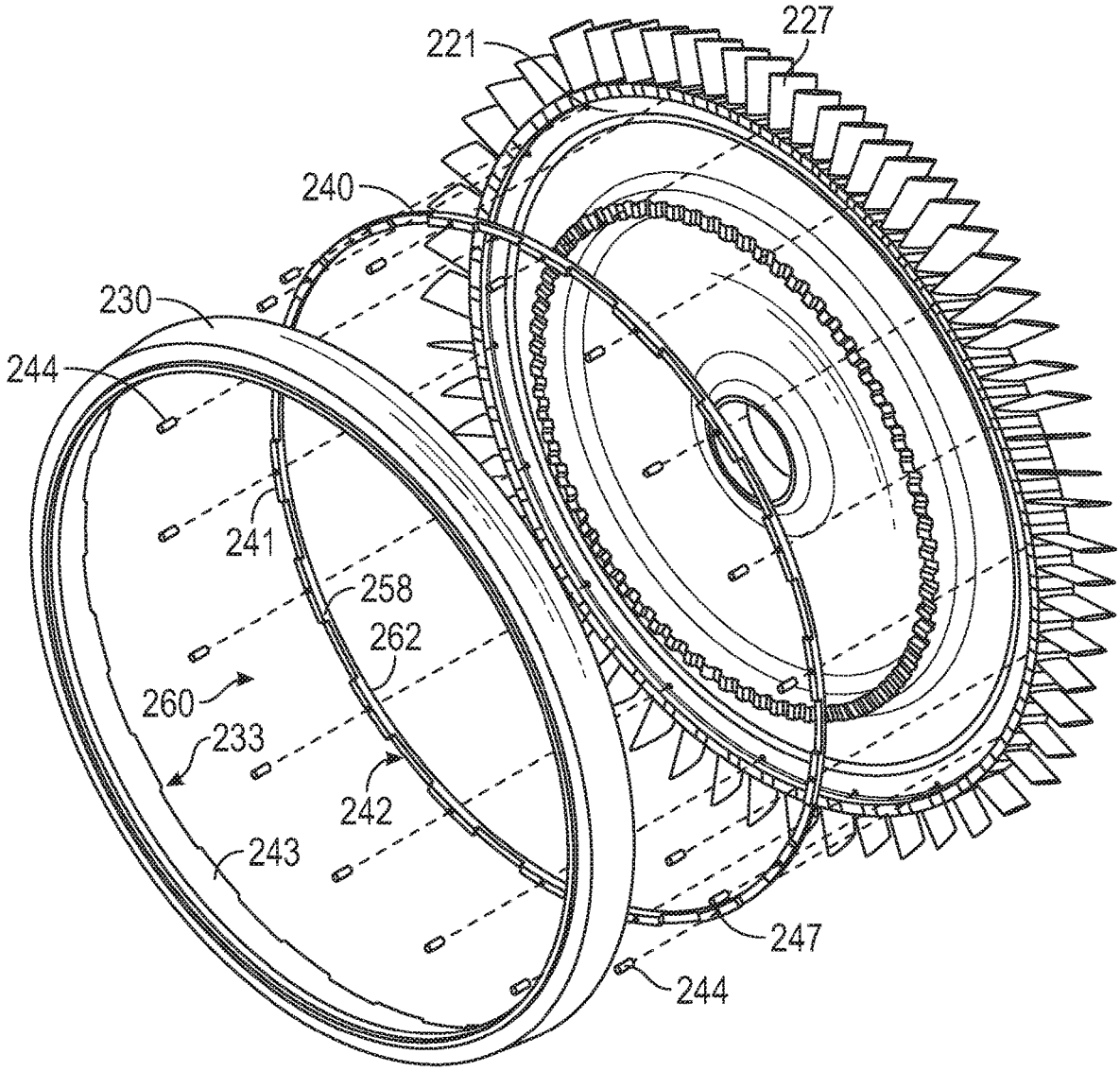
FIG. 4 is an exploded view of the compressor disk and spacer of FIG. 3.

FIG. 4 is an exploded view of the compressor disk and spacer of FIG. 3. The cross key ring 240 can have an annular body 258 and a plurality of anti-rotation features or keys 241. Each of the keys 241 can be separated by a gap 242. In some embodiments the cross key ring 240 can have 18 or more keys 241. It should be appreciated by those skilled in the art that the number of keys 241 can vary based on diameter of the spacer 230 and the diameter of the cross key ring 240. In some embodiments, an increased number of keys 241 may reduce stresses on the components of the compressor disk assembly 220 and the compressor rotor assembly 210. For the example shown, 18 keys may provide a balance between acceptable stress values and complexity of increased machining for an increased number of keys 241. In some embodiments, the cross key ring 240 may have more than 18 keys 241. In some other embodiments, the cross key ring 240 used to retrofit a compressor disk assembly 220 may further be limited in the number of keys 241 given the thin structure of the annular body 258. The keys 241 can be castellations or teeth that alternate with the gaps 242 to form a cross key surface 260. The keys 241 and the gaps 242 mesh with corresponding spacer teeth 243 (FIG. 5) on the body 231 of the spacer 230. Each cross key ring 240 can further have a ring aft face 262 opposite the cross key surface 260.

The cross key ring 240 can also have a plurality of cross key installation pins (pins) 244 that secure the cross key ring 240 to the disk 221 via apertures 247. In some examples, the cross key ring 240 can be installed as a retrofit to the disk 221. The pins 244 can aid in securing the cross key ring 240 and preventing it from warping, for example, during installation.

The cross key ring 240 can be coupled to the disk 221 via an interference fit. The pins 244 can be tapped through apertures 247 into corresponding apertures in the disk 221 to further secure the cross key ring 240 to the disk 221. In some embodiments, the disk 221 can be retrofitted with the cross key ring 240 by machining the outer portion of the disk 221 in to accommodate the cross key ring 240. Specifically, one or more of the forward extension face 228, the forward extension inner surface 251, and the forward disk face 616 (FIG. 7) can be machined or otherwise retrofitted to receive and accommodate the cross key ring 240.

In some other embodiments the cross key ring 240 can be an integral portion of the disk 221 and formed in the disk 221 as an original and unitary component. This can eliminate the use of the pins 244 and the apertures 247, for example.

Figure 5:
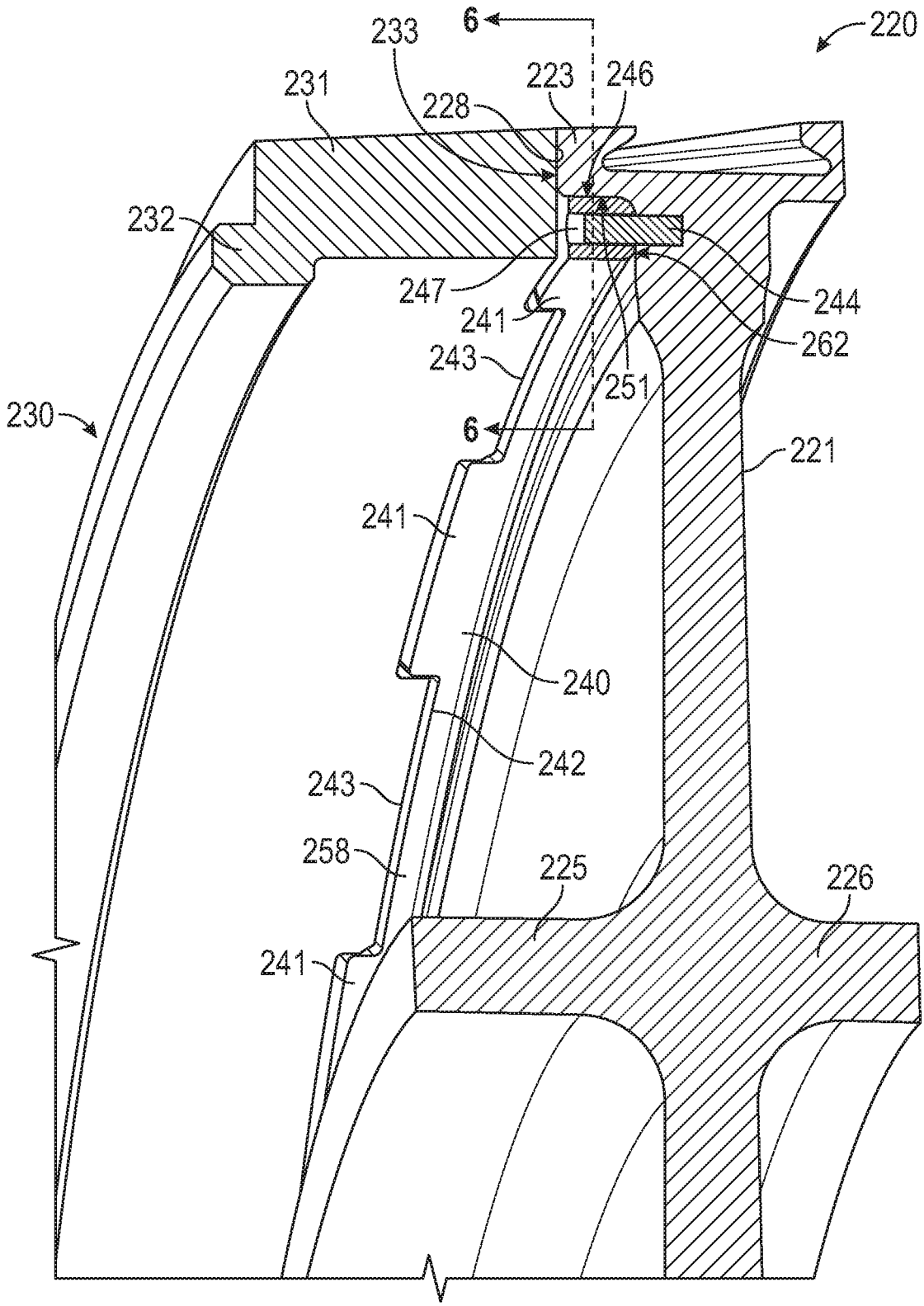
FIG. 5 is a cross-sectional view of a portion of the compressor 200 of a gas turbine engine which may be used in the gas turbine engine 100 of FIG. 1.

FIG. 5 is a cross-sectional view of a portion of the compressor 200 of a gas turbine engine which may be used in the gas turbine engine 100 of FIG. 1. The view of FIG. 5 is similar to FIG. 3, depicting a close up view of the disk 221, the spacer 230, the cross key ring 240.

In some embodiments, the cross key ring 240 can be coupled to the disk 221 via an interference fit. Thus the cross key ring 240 can be sized such that a cross key ring outer surface 246 meets a forward extension inner surface 251. The cross key outer surface 246 can define an outer circumference of the cross key ring 240. The cross key ring 240 is further disposed between the disk 221 and the spacer 230 such that the aft face 233 of the spacer 230 is in contact with a forward extension face 228.

In some embodiments, the cross key ring 240 can be installed in the gas turbine engine 100 as a retrofit. In such an implementation, the spacer 230 can be modified or machined to receive the cross key ring 240 in an interference fit. The pins 244 can secure the cross key ring 240 to the spacer 230, and can be tapped into the apertures 247 in the cross key ring 240 and corresponding apertures in the disk 221. The pins 244 can be secured in an interference fit within the cross key ring 240 and the disk 221. In other embodiments, the pins 244 can be secured via a weld or adhesive. In some embodiments, the cross key ring 240 can be integral to the disk 221, eliminating the pins 244 and additional modification to the disk 221.

During operation of the gas turbine engine, particularly during transient operations such as startup and shutdown, the radial fits of the forward and aft ends of each spacer 230 may increase or decrease due to thermal expansion and contraction. This can increase the chances of the spacer 230 rotating relative to disk 221. The keys 241 of the cross key ring 240, in connection with the spacer teeth 243 can prevent the spacer 230 from slipping or rotating in relation to the adjacent disk 221. The keys 241 can couple with the spacer teeth 243 in a male-female interaction to prevent rotation. The pins 244 and the interference fit between the cross key ring 240 and the disk 221 can prevent the cross key ring 240 from slipping relative to the disk 221.

Figure 6:
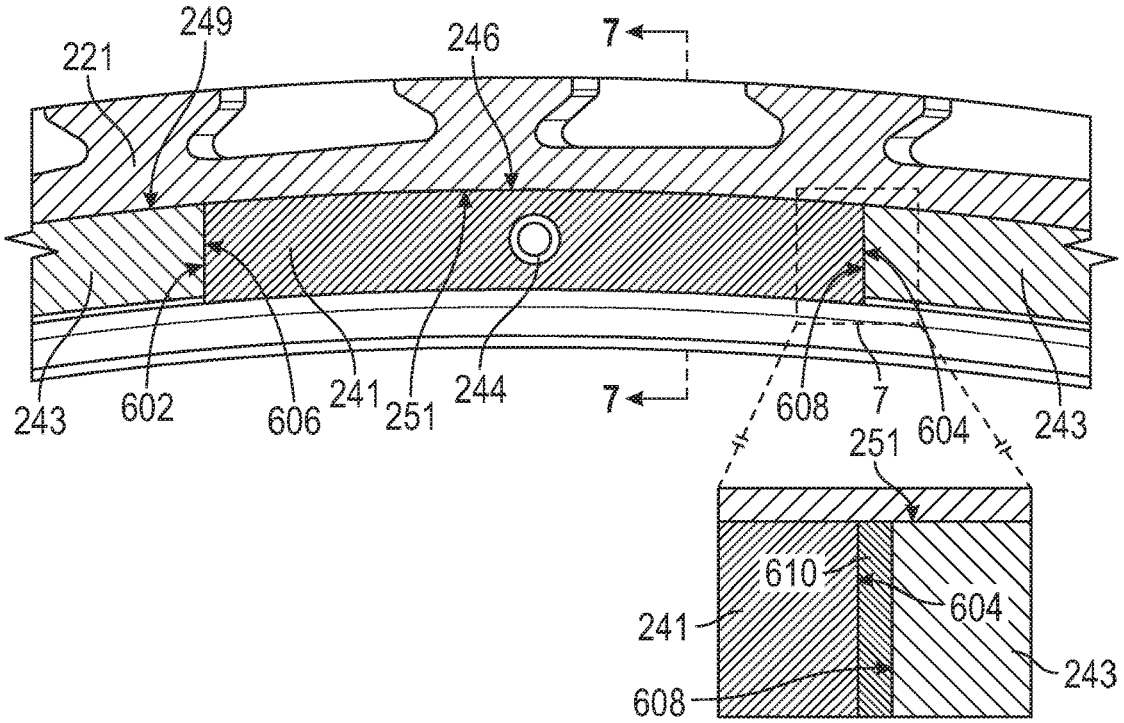
FIG. 6 is a cross-sectional view of a portion of the compressor 200 of the gas turbine engine of FIG. 1 taken along the line 6-6 of FIG. 5.

FIG. 6 is a cross-sectional view of a portion of the compressor 200 of the gas turbine engine of FIG. 1 taken along the line 6-6 of FIG. 5. The view of FIG. 6 is an axial cross-section of the compressor 200 looking forward. This view shows a radial cross-section of the keys 241 and the spacer teeth 243.

In some embodiments both the spacer 230 and the cross key ring 240 can have the same outer diameter. This can allow the cross key ring 240 to properly pilot on the compressor disk 221 and allow the spacer teeth 243 to overlap in an axial direction with the forward extension 223 of the disk 221. Thus, the forward extension inner surface 251 can be adjacent to the cross key ring outer surface 246. Thus, the forward extension inner surface 251 can also overlap with the spacer teeth 243 (see FIG. 7). The interference fit between these adjacent surfaces can prevent rotation. In a similar manner, the forward extension inner surface 251 can also be adjacent to a spacer tooth outer surface 249. The spacer tooth outer surface 249 can be a portion of the spacer 230 in contact with the disk 221. When operating at temperature, the spacer 230 expands (in a radial direction) faster than the disk 221. Accordingly, the spacer 230 heats up and expands and tightens the interference fit with the disk 221, and more specifically, the forward extension inner surface 251.

In some embodiments, each of the keys 241 can have a first key locking surface 602 and a second key locking surface 604. The first key locking surface 602 can be adjacent to a spacer tooth first surface 606. The second key locking surface 604 can be adjacent to a spacer tooth second surface 608. As shown, each key 241 is a sector of the cross key ring 240, shaped as an annular sector, having curved-trapezoidal cross-section. In addition, there can be a small circumferential gap 610 where the first key locking surface 602 is adjacent the spacer tooth first surface 606, and where the second key locking surface 604 is adjacent the spacer tooth second surface 608. This is shown in the inset of FIG. 6.

Using the inset of FIG. 6 as an example, the circumferential gap 610 provides room for the spacer 230 to expand and contract during startup and shutdown. This circumferential gap 610 can also provide sufficient clearance for installation or coupling of the spacer 230 to disk 221. For example, as the spacer 230 heats up and expands during turbine operation, the spacer 230 may lose engagement with the cross key ring 240. More specifically, first surface 606 may lose contact with the first key locking surface 602 and the spacer tooth second surface 608 may lose contact with the second key locking surface 604 during turbine operation, but spacer 230 expands such that the spacer tooth outer surface 249 contacts the forward extension inner surface 251. This can increases the friction of the interference fit between the spacer 230 and the disk 221 and aid in the prevention of rotation between the spacer 230 and the disk 221.

During shutdown, the spacer 230 can cool faster than the disk 221 thus the spacer 230 and spacer teeth 243 can engage with keys 241 of the cross key ring 240, and restrict the spacer 230 from rotating. More specifically, as the spacer 230 cools, it may lose contact with the forward extension inner surface 251, but then contact with the second locking surface 604 and reengage with the cross key ring 240.

Figure 7:
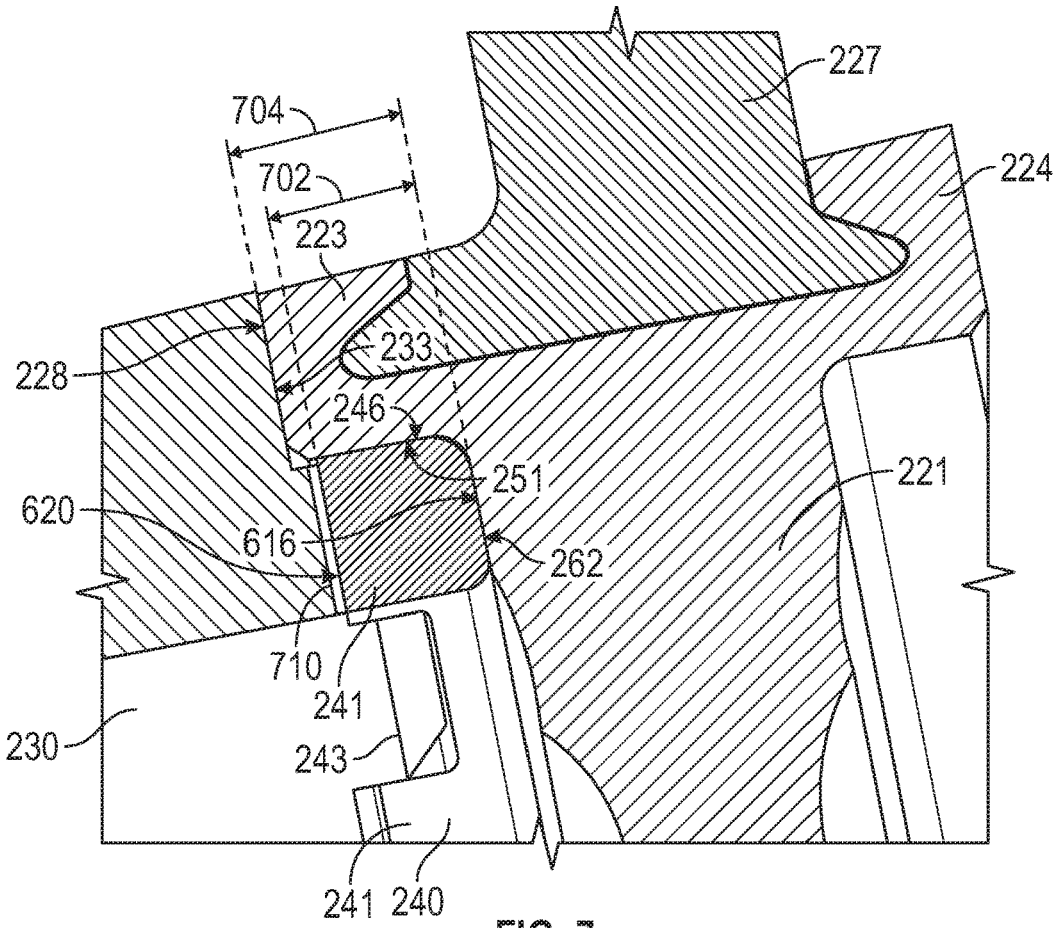
FIG. 7 is a cross-sectional view of a portion of the compressor 200 of the gas turbine engine of FIG. 1 taken along the line 7-7 of FIG. 6.

FIG. 7 is a cross-sectional view of a portion of the compressor 200 of the gas turbine engine of FIG. 1 taken along the line 7-7 of FIG. 6. In some embodiments, the cross key ring 240 can have a cross key ring depth indicated by an arrow (ring depth) 702. The ring depth 702 can extend from a ring aft face 262 to a key face 620.

The forward extension 223 can have an extension depth 704 extending from a forward disk face 616 to the forward extension face 228 of the forward extension 223 adjacent to the aft face 233. The extension depth 704 can be slightly larger (or deeper) than the ring depth 702. The difference in depths provides a ring gap 710 between the key face 620 and the aft face 233 of the spacer 230. The ring gap 710 can prevent the cross key ring 240 from obstructing the interference fit between the spacer 230 and the disk 221. This allows the spacer 230 to bottom out onto the disk 221 where the aft face 233 meets the forward extension face 228.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 390 via injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

The compressor 200 can have the series of disk assemblies 220. Each disk assembly 220 can have a spacer 230 adjacent to the disk 221. During startup and shutdown of the gas turbine engine 100, various components including the disk assemblies 220 are subjected to large rotational forces. The rotational forces can cause the spacer 230 to rotate with relation to the disk 221. This can cause wear between the components and damage over time.

As disclosed herein, the cross key ring 240 having the keys 241 can be inserted into or affixed the disk 221. The keys 241 can interact with the spacer teeth 243 and prevent such rotation. In some embodiments the cross key ring 240 can be inserted as a retrofit to the disk 221. This can require machining of the outer circumference of the forward face of the disk 221. The cross key ring 240 can then be inserted into the appropriate space and the disk 221 via an interference fit.

The pins 244 can also be inserted into the apertures 247 within the cross key ring to further secure the cross key ring 240 from rotating with respect to the disk 221. The spacer 230 can thus be formed with corresponding spacer teeth that interlock with the keys 241.

In other embodiments, the cross key ring 240 can be formed as an integral portion of the disk 221. This can allow one for one replacement during engine overhaul or retrofit.

The prevention of rotation between the spacer 230 and the disk 221 during transient engine operations (e.g., startup and shutdown) can prolong the life of the compressor assemblies 220 and ultimately the gas turbine engine 100.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular power turbine flange assembly, it will be appreciated that the aft clamp ring in accordance with this disclosure can be implemented in various other configurations, can be used with various other types of flange assemblies, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

It will be understood that the benefits and advantages described above may relate to one embodiment or may relate to several embodiments. The embodiments are not limited to those that solve any or all of the stated problems or those that have any or all of the stated benefits and advantages.

What is claimed is:

1. A compressor disk assembly comprising:

a cross key ring having, an annular body having a circumference defined by an outer surface, and a ring aft face orthogonal to the outer surface, and a plurality of keys alternating with a plurality of gaps forming a cross key surface opposite the ring aft face, each key of the plurality of keys spanning an annular sector of the cross key surface; and a compressor disk configured to receive a plurality of compressor blades about an outer circumference, the compressor disk having, a rim extending from an outer portion of the compressor disk defining the outer circumference of the compressor disk, a forward disk face disposed radially inward from the rim' and a forward extension extending axially forward from the rim and defining an extension depth, the extension depth extending from the forward disk face to a forward extension face along a forward extension inner surface, the forward extension being configured to receive the cross key ring in an interference fit with the forward extension inner surface, such that the ring aft face is disposed adjacent to the forward disk face, and the outer surface adjacent to the forward extension inner surface.

2. The compressor disk assembly of claim 1, wherein one or more of the plurality of keys comprises a key aperture extending from a key face of the one or more keys of the plurality of keys to a ring aft face, each key aperture corresponding with a disk aperture formed in the compressor disk, wherein each key aperture and corresponding disk aperture are configured to coaxially receive a corresponding pin.

3. The compressor disk assembly of claim 1, wherein the plurality of keys and alternating plurality of gaps are equally distributed about the cross key surface.

4. The compressor disk assembly of claim 1, wherein the cross key ring comprises a ring depth defining a distance from the aft ring surface to a key face of each key of the plurality of keys.

5. The compressor disk assembly of claim 4, wherein the ring depth is less than the extension depth of the forward extension.

6. A method for retrofitting a gas turbine engine, the method comprising:

forming a forward disk face on a compressor disk radially inward from a rim, the rim having an outer surface defining a disk outer surface of the compressor disk, the rim configured to receive a plurality of rotor blades about the disk outer surface;

forming a forward extension inner surface extending an extension depth from the forward disk face of the compressor disk to a forward extension face of a forward extension, the forward extension extending axially forward from the rim; and fitting a cross key ring to the compressor disk, the cross key ring having a plurality of keys alternating with a plurality of gaps forming a cross key surface opposite a ring aft face, each key of the plurality of keys spanning an annular sector of the cross key surface, the fitting further disposing the ring aft face adjacent the forward disk face.

7. The method of claim 6 further comprising fitting an outer surface of a circumference of the cross key ring adjacent to the forward extension inner surface.

8. The method of claim 7 wherein the spacer further comprises a spacer body having a substantially annular shape and a spacer outer surface disposed flush with the disk outer surface.

9. The method of claim 6 further comprising fitting a spacer to the compressor disk, the spacer having a plurality of spacer teeth formed on an aft face of the spacer body, each spacer tooth of the plurality of spacer teeth spanning an annular sector of the ring aft face, the plurality spacer teeth engaging with the plurality of keys.

10. The method of claim 6 wherein the cross key ring comprises a ring depth extending a distance from the aft ring surface to a key face of the plurality of keys, the ring depth being less than the extension depth.

* * * * *